US006163937A

United States Patent [19]

McKinnis et al.

[11] Patent Number: 6,163,937

[45] Date of Patent: Dec. 26, 2000

[54] BRA STRAP CONVERTER

[76] Inventors: Crystal McKinnis; Heather McKinnis, both of 4507 Lorna Pl., Las Vegas, Nev. 89107

[21] Appl. No.: 09/245,045

[22] Filed: Feb. 5, 1999

Related U.S. Application Data

[60] Provisional application No. 60/104,603, Oct. 16, 1998.

[51] Int. Cl.[7] ..... A44B 18/00; A41C 3/00

[52] U.S. Cl. ..... 24/302; 2/323

[58] Field of Search ..... 24/302, 265 BC, 24/265 CC, 265 H, 309, 182, 196, 197, 198; D2/624; 2/323, 268; 450/86, 88

[56] References Cited

U.S. PATENT DOCUMENTS

| | | | |
|---|---|---|---|
| D. 383,888 | 9/1997 | Smith | D2/624 |
| 1,401,227 | 12/1921 | Wyeth | 2/323 |
| 1,936,127 | 11/1933 | Dunlevy | 2/323 X |
| 2,529,774 | 11/1950 | Landau | 2/323 X |
| 2,736,899 | 3/1956 | Ayers | 2/323 |
| 2,739,315 | 3/1956 | Heliotis | 2/323 |
| 3,672,004 | 6/1972 | Smith | 24/302 |
| 4,704,745 | 11/1987 | Reaver | 2/268 |
| 4,764,988 | 8/1988 | Reaver | 2/268 |
| 4,858,249 | 8/1989 | Stewart | 24/305 |
| 4,953,233 | 9/1990 | Moshier | 2/268 |
| 5,149,293 | 9/1992 | Gable | 450/86 |
| 5,308,278 | 5/1994 | Huang | 450/86 |
| 5,558,556 | 9/1996 | Froehlich | 450/86 |
| 6,038,745 | 3/2000 | Rapp | 24/302 X |

FOREIGN PATENT DOCUMENTS

| | | | |
|---|---|---|---|
| 460066 | 9/1949 | Canada | 24/302 |
| 16617 | of 1894 | United Kingdom | 24/302 |
| 18810 | of 1896 | United Kingdom | 24/302 |
| 818 | of 1904 | United Kingdom | 24/302 |

*Primary Examiner*—Robert J. Sandy
*Attorney, Agent, or Firm*—Burns, Doane, Swecker & Mathis, L.L.P.

[57] ABSTRACT

A bra strap converter for pulling bra straps closer together is provided. The bra strap converter includes a slide and a fastening apparatus, which can be constructed in three different ways. The slide allows the size of the bra strap converter to be adjusted, and may include hooks at each end that functions by attaching to each shoulder strap of the bra in the area across the shoulder blades. Alternatively, an elastic strap may include a hook-and-eye closure apparatus which allows the bra strap converter to be looped around the shoulder strap of the bra and hook together. In addition, a method is disclosed for using a detachable bra strap which includes a first attachment part at one end of the attachable bra strap and a second attachment part at another end attachable bra strap. The attachable bra strap is looped around both should straps of the bra in an area across the shoulder blades of a wearer and the first part is attached to the second part thereby pulling the shoulder straps closer together with a result of concealing the shoulder straps beneath garments which would otherwise reveal the shoulder strap.

13 Claims, 5 Drawing Sheets

BRA STRAP CONVERTER

This application claim benefit to provisional application Ser. No. 60/104,603 filing data Oct. 16, 1998.

FIELD OF THE INVENTION

This invention is a device which pulls bra straps closer together in the area across the shoulder blades for the purpose of concealing the bra straps beneath racerback-style tops and dresses and consists of an elastic strap, a size adjustment device known as a slide, and a hook and loop fastening apparatus.

BACKGROUND OF THE INVENTION

Many sleeveless tops and dresses are designed in a racerback style wherein the arm holes are cut more deeply into the area over the shoulder blades in such a way that allows the straps of a conventional bra to remain exposed in the area over the shoulder blades.

A conventional bra is defined as a bra wherein the shoulder straps originate at the tops of the breast cups, curve vertically over the tops of the shoulders and attach to the top of the main strap which originates from the lower outer edges of both breast cups, curves horizontally around the sides and back of the ribcage and attaches in the center back with a hook-and-loop apparatus. The shoulder straps attach to the ribcage strap at a point which is approximately 3" to 3½" from the center back causing a 6" to 7" separation between the shoulder straps.

The typical way of addressing the problem of bra straps showing beneath racerback-style garments is to wear a front-closure racerback-style bra wherein the shoulder straps originate at the top of the breast cups, curve over the tops of the shoulders and attach to a trapezoid shaped center matrix made of poly-directional elastic in the back. This type of design, allows for a 1" to 3" separation between the bra straps at the point of attachment in the back which causes the bra straps to remain concealed beneath clothing which has arm holes cut in the racerback style.

There are several drawbacks to the design of the racerback bra. First, the ribcage portion of the racerback bra cannot be adjusted in size. But the ribcage strap of a conventional bra can be adjusted in size by way of an adjustable hook-and-loop apparatus which attaches the two ends in the back.

In addition, the front closure of the racerback bra can pose a problems for some women. Large breasted women need a more secure closure to avoid the embarrassment of the closure apparatus becoming detached at an unexpected moment.

Another problem could simply be a matter of availability or personal preference. An individual who wishes to wear a racerback-style top or dress may not own a racerback bra or may not have it on hand at the moment. Or they may simply prefer the color, styling and texture of a particular conventional bra.

A click-back bra involves a metal ring sewn into each shoulder strap of the bra in the area over the shoulder blades approximately 2" above the ribcage strap. The bra straps can either be worn as a conventional bra or a small metal device can be used to bind the two aforementioned rings together, thereby pulling the shoulder straps closer together.

Though this type of bra allows the wearer to convert a conventional style bra to a racerback style bra, the characteristic that allows this conversion to take place is designed into the structure of the bra itself, This means that the apparatus which allows the conversion of the bra straps cannot be transferred from bra to bra. It also means that a bra wearer will have to pay full price for a bra rather than the price of one inexpensive bra strap converter that can be used on every conventional-style bra that she owns.

U.S. Pat. No. 4,858,249 to Stewart pertains to a shoulder strap fastening device comprised of a strap made of nylon web and a hook and pile release-fastening material. The strap fastening device forms loops at either end that circle around the straps. This device was designed to be used to secure shoulder straps, or suspenders, on an outer garment. The device is completely inadequate to solve the problem of converting a conventional bra into a racerback style bra for several reasons.

First, this device would be quite bulky and would likely be conspicuous beneath the garment. It would also scratch the skin causing discomfort.

Even if the device was scaled down so as to avoid a conspicuous bulky appearance, the smaller hook and pile release-fastening material, commonly known as VELCRO, would likely not be strong enough to withstand the tension of bra straps being pulled closer together. It would also still be scratchy.

Design Pat. No. D383,888 is a bra strap holder similar in shape and design to the shoulder strap fastening device mentioned above but comprised of a smaller adjustable strap with snap closures at each end that form loops that circle the bra straps in back for the purpose of holding them in place.

This device is also inadequate for the purpose of converting a conventional bra to a racerback bra. Though the device is adjustable in length, it is designed to hold bra straps in place, not pull them closer together. Because of this design specification, if the strap was adjusted to its smallest length, it would not provide the proper range of size necessary to pull bra straps an all sizes of bras close enough together so that the straps would not show beneath some of the more extreme racerback style clothing.

An even greater limitation inherent in this design is the male/female snap closures on either end of the device which loop around the straps of the bra. Though this type of closure is adequate for holding bra straps in place, the naps could not provide a secure enough closure for pulling the straps closer together. The process of pulling the straps closer together, especially if the bra is being worn by a woman with large breasts, places tension on the closing apparatus of the bra strap converter. For this reason, the closure apparatus must be of the type that could withstand the extra tension, providing security for the wearer.

SUMMARY OF THE INVENTION

Several objects and advantages of the bra strap converter are:

(a) to allow the wearer an easy solution to the problem of her bra straps showing while wearing certain styles of clothing;

(b) to allow the wearer to adjust the amount of space between the bra's shoulder straps in the area across the shoulder blades for the sake of comfort and fit;

(c) to solve the problem of the less secure front closure of the racerback bra;

(d) to allow the wearer a larger choice when deciding which bra to wear with a racerback style garment;

(e) to allow the wearer a less expensive alternative to the racerback-style bra; and (f) to allow the wearer the capability of converting all of her conventional bras to racerback-style bras with just one simple device.

The present invention comprises:

an adjustable elastic strap approximately 6" to 8" in length, fitted a size adjustment device known as a slide, with hooks at each end of the invention that fasten onto each bra strap in the area over the shoulder blades;

an elastic strap, approximately 3" in length, with a pre-fabricated hook-and-eye closure apparatus attached to each end of said elastic strap such that the hook portion of said hook-and-eye closure apparatus is attached to one end said elastic strap and the eye portion of said hook-and-eye closure apparatus is attached to the other end of said elastic strap;

a new use for a detachable bra strap.

BRIEF DESCRIPTION OF THE DRAWINGS

DRAWINGS

Figure 1:
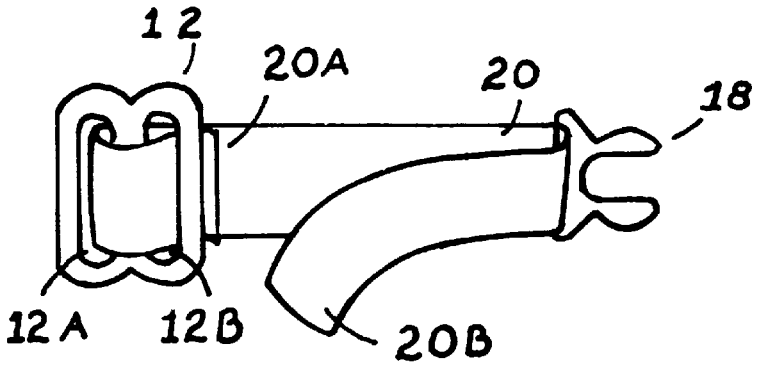

FIG. 1 illustrates a perspective view of a first embodiment of the present invention.

Figure 2:
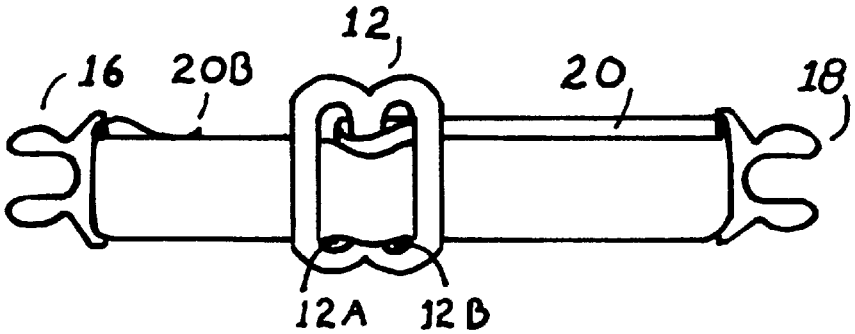

FIG. 2 illustrates a perspective view of the first embodiment of the invention.

Figure 3:
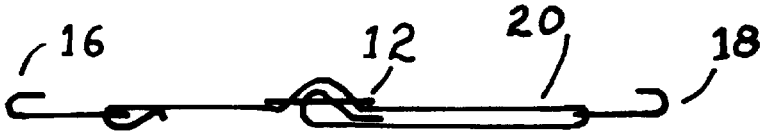

FIG. 3 illustrates a side view of the first embodiment shown in FIG. 2.

Figure 4:
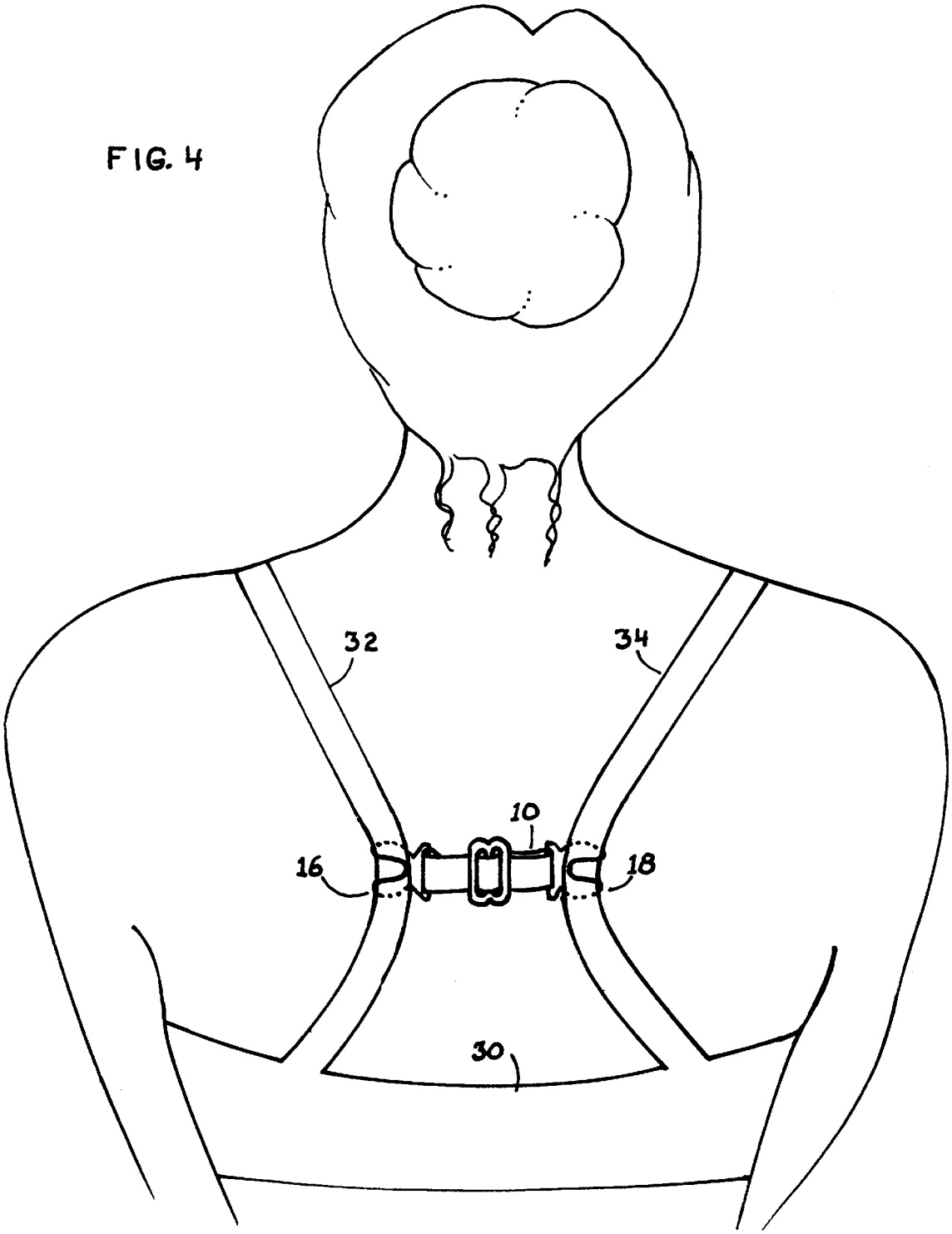

FIG. 4 illustrates the first embodiment of the invention in usage.

Figure 5:
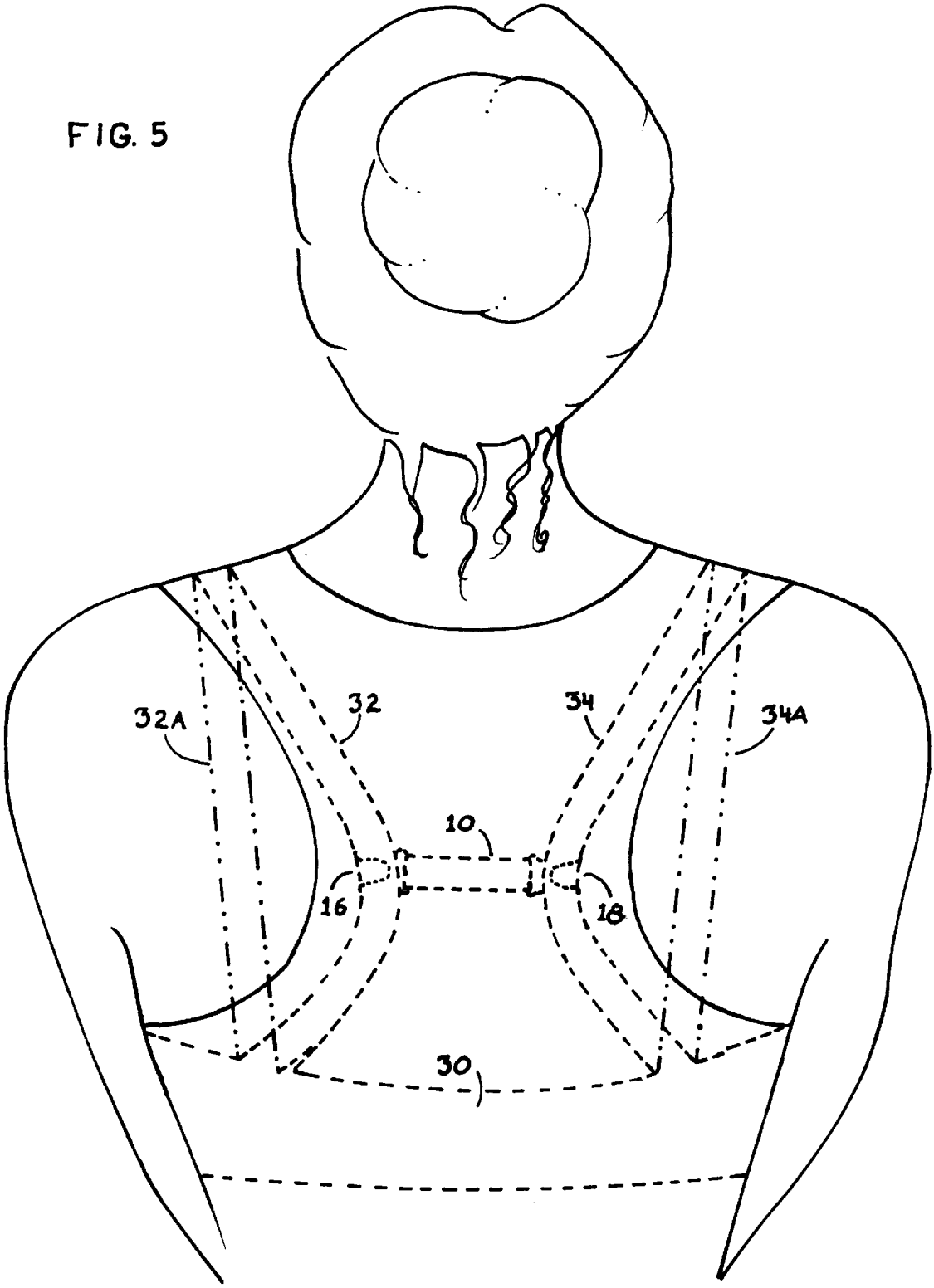

FIG. 5 illustrates the first embodiment of the invention in usage.

Figure 6:
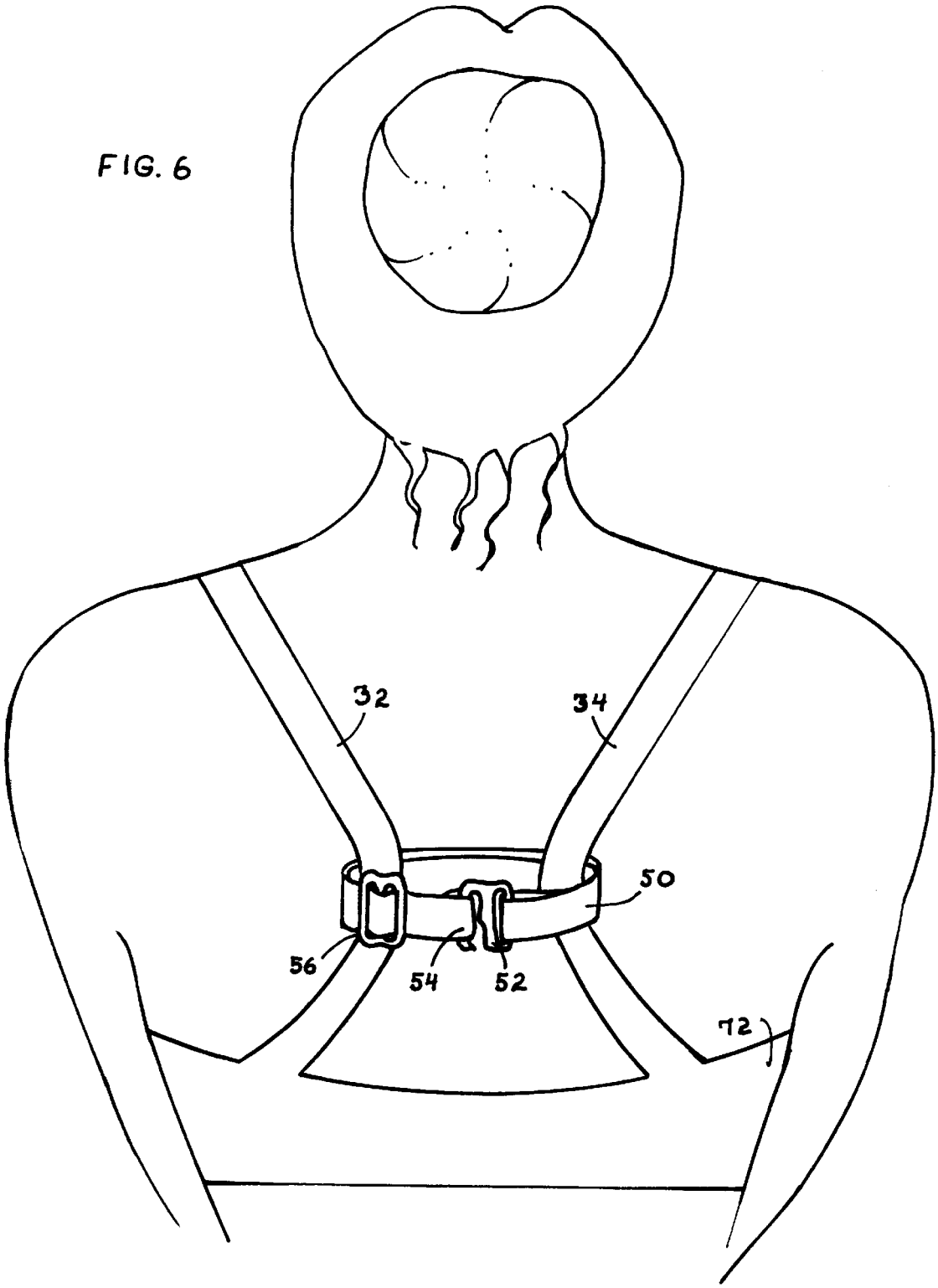

FIG. 6 illustrates a second embodiment of the invention in usage.

Figure 7:
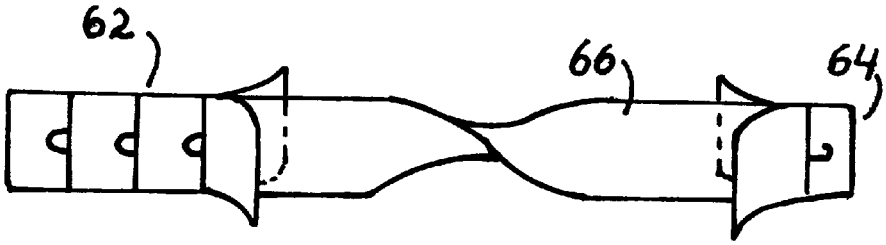

FIG. 7 illustrates a third embodiment of the invention.

Figure 8:
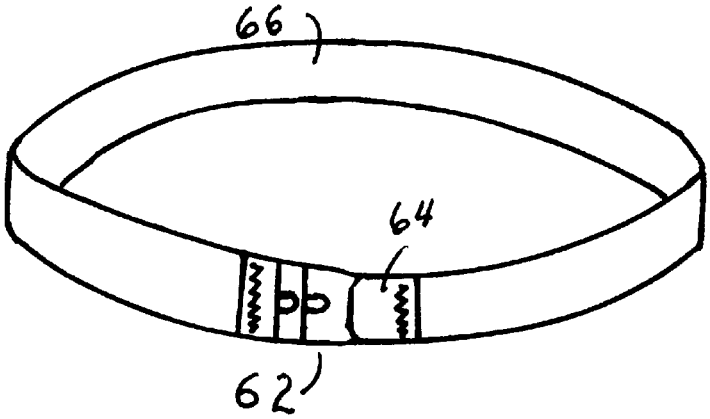

FIG. 8 illustrates the third embodiment of the invention.

The first aforementioned strap is worn by securing each bra strap into each hook in the area several inches above the ribcage strap of the bra;

The second aforementioned strap is worn by looping it around the bra straps in the area across the shoulder blades and securing the strap by connecting the pre-fabricated hook-and-eye closure apparatus;

The third aforementioned strap is worn by looping it around the bra straps in the area across the shoulder blades and securing the strap by inserting the hook into the loop formed by the end of the strap.

The aforementioned elastic strap could be sateen bra-strap elastic either ⅜" or ½" or 1" in width.

The slide on the invention allows for adjustability as to how wide the device will be and thus how closely the bra's shoulder straps are pulled together, accommodating various fits and sizes.

The device can be adjusted either up or down along the bra straps for comfort or fit. The tension created when the bra straps are pulled closer together has the effect of preventing slippage.

The invention will be more fully understood from the following detailed description taken in conjunction with the accompanying drawing in which: FIGS. 1, 2, and 3 consist of a strip of elastic approximately 12" long and ½" wide 20, a metal or plastic slide 12, and two hooks made of shaped wire 16 and 18.

In FIG. 1, the slide is attached to the invention by threading the first end of the elastic strip 20A up through the first opening of the slide 12A and down through the second opening 12B. The slide 12 is attached to the elastic 20 by forming a loop at the first end of the elastic 20A and securing it by sewing or some other means.

The first metal hook 18 is attached to the invention by threading the second end of the elastic strip 20B through the hook 18 and moving the hook 18 halfway down the length of the elastic strip 20. The second end of the elastic strip 20B is then threaded up through the second opening of the slide 12B and down through the first opening 12A. The second end of the elastic strip 20B is then threaded through the second hook 16 and attached by forming a loop at the second end of the elastic 20B and securing it by sewing or some other means.

FIG. 3 shows the lateral view of the bra strap converter.

FIGS. 4 and 5 illustrates the way the bra strap converter device functions in actual usage. In FIG. 4, the bra strap sizing device 10 is attached to the bra 30 by attaching the hooks 16 and 18 to the bra straps 32 and 34 thereby pulling the bra straps closer together.

FIG. 5 shows how the bra straps 32 and 34 are concealed beneath a racerback style garment. It also shows the alternative position of the bra straps 32A and 34A if the bra strap converter device was not in use.

FIG. 6 shows how bra straps are pulled more closely together by a detachable bra strap.

FIGS. 7 and 8 shows how an elastic strap 66 with a pre-fabricated hook 64 and loop 62 closure apparatus, attached to each end of said elastic strap 66 by sewing or some other means of attachment, can be fastened into a eye FIG. 8 which can serve the same purpose of pulling bra straps closer together.

Accordingly, the reader will see that the bra strap converter provides a reliable, inexpensive and convenient means of solving the problem of bra straps showing beneath racer-back style garments. One bra strap converter could be used on a number of bras and can be adjusted in size to accommodate a variety of fits and sizes.

Although the description above contains many specifications, these should not be construed as limiting the scope of the invention but as merely providing illustrations of some of the presently preferred embodiments of this invention. For example, the strip used to make the bra strap converter could be either elastic or non-elastic and could be a variety of colors. The bra strap converter could be assembled without the slide to make way for ornamentation of the strap such as lace, rhinestones, chains, etc.

The hooks used could be of a variety of different shapes, sizes, or styles. The hooks could be made out of a variety of materials such as plastic, metal, or resin and come in a variety of-different colors.

The hooks could also be of a style which would allow for ornamentation. For example, the hook portion of the bra strap converter could be comprised of a flat surface that could accommodate a decal, a logo, or some other type of ornamentation and be equipt with a hook type of structure on the side or underside of this arrangement.

Clips could be used to secure the bra straps instead of hooks.

We claim:

1. A bra strap converter for pulling bra straps closer together, comprising:

an elastic strap fitted with a slide by way of looping said elastic strap through said slide and attaching said slide to said elastic strap;

a first hook, wherein said first hook is attached to said elastic strap by threading a first end of said elastic strap, which is not attached to said slide, through said first hook before said first end of said elastic strap is threaded through said slide;

a second hook wherein said second hook is attached to said elastic strap by threading a second end of said elastic strap, which is not attached to the slide, through said second hook and fastening said second hook to said second end of said elastic strap.

2. The bra strap converter of claim 1, wherein said slide is attached to said elastic strap by sewing.

3. The bra strap converter of claim 1, wherein said first hook is fastened to said elastic strap by sewing.

4. A method of using a detachable bra strap having a first attachment part at one end of the detachable bra strap, and a second attachment part at another end of the detachable bra step, the method comprising the steps of:

looping the detachable bra strap around both shoulder straps of a bra in an area across the shoulder blades of a wearer; and attaching the first attachment part to the second attachment part thereby pulling the shoulder straps closer together with the result of concealing the shoulder straps beneath garments which would otherwise reveal the shoulder strap.

5. The method of claim 4, wherein said first attachment part is a hook and said second attachment part is a loop.

6. The method of claim 4, wherein said first attachment part is a hook part of a hook-and-eye closure device and said second attachment part is an eye part of a hook-and-eye closure device.

7. The method of claim 6, wherein said second attachment part is a series of three eye parts.

8. A bra strap converter, comprising:

a pre-fabricated hook-and-eye closure apparatus including two parts wherein the first part is comprised of at least one hook which is embedded in a first piece of fabric and the second part is at least one eye part which is imbedded in a second piece of fabric;

said first part of said pre-fabricated hook-and-eye closure apparatus is attached to one end of said elastic strip;

said second part of said pre-fabricated hook-and-eye closure apparatus is attached to another end of said elastic strip.

9. The bra strap converter of claim 8, wherein said second part is a series of three eye parts.

10. The bra strap converter of claim 8, wherein said hook-and-eye closure apparatus is made from metal.

11. The bra strap converter of claim 8, wherein said first hook is attached to one end of said elastic strip by sewing.

12. The bra strap converter of claim 8, wherein said eye part is attached to the remaining end of said elastic strip by sewing.

13. The bra strap converter of claim 8, wherein said first and second pieces of fabric are made from polyester and are rectangular in shape.

* * * * *